US008774421B2

(12) United States Patent
Kimura

(10) Patent No.: US 8,774,421 B2
(45) Date of Patent: Jul. 8, 2014

(54) NOISE CANCELING HEADPHONE AND NOISE CANCELING EARMUFF

(75) Inventor: Tominori Kimura, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 284 days.

(21) Appl. No.: 13/232,046

(22) Filed: Sep. 14, 2011

(65) Prior Publication Data

US 2012/0063611 A1 Mar. 15, 2012

(30) Foreign Application Priority Data

Sep. 15, 2010 (JP) ..... 2010-206385

(51) Int. Cl.
*H04R 1/10* (2006.01)

(52) U.S. Cl.
USPC ..... 381/74; 381/73.1; 381/72; 381/71.6; 455/570; 455/114.2; 379/406.03; 379/406.14

(58) Field of Classification Search
CPC .... H04R 1/1083; H04R 1/1091; H04R 25/43; H04R 25/48; H04R 25/50; H04R 25/75
USPC ..... 381/23.1, 302, 309, 26, 61, 314, 317, 381/71.1, 71.6, 71.8, 71.11, 71.12, 71.14, 381/71.13, 72, 73.1, 74, 80, 81, 83, 85, 86, 381/91, 92, 93, 94.1, 94.5, 94.6, 94.7, 94.8, 381/95, 96, 98, 103, 101, 102, 108, 119, 381/120, 121, 122, 123; 704/E19.014, 704/E21.002; 379/406.01–406.16; 455/570, 455/569.2, 114.2, 575.2; 700/94
See application file for complete search history.

(56) References Cited

U.S. PATENT DOCUMENTS

2005/0276421 A1* 12/2005 Bergeron et al. ..... 381/71.6
2009/0285408 A1* 11/2009 Kimura ..... 381/71.6

FOREIGN PATENT DOCUMENTS

JP 2006-14307 1/2006

* cited by examiner

*Primary Examiner* — Leshui Zhang
(74) *Attorney, Agent, or Firm* — Whitham Curtis Christofferson & Cook, PC

(57) ABSTRACT

A noise canceling headphone includes a microphone provided in a headphone housing, collecting external sound, a canceling signal generating circuit generating a canceling signal in response to a signal output from the microphone which cancels external sound passing through the housing without being attenuated by a sound insulating characteristic of the headphone, a compensating signal generating circuit generating a compensating signal that compensates for the external sound attenuated by the sound insulating characteristic of the headphone, an adding circuit that adds a musical signal input from the exterior to the compensating signal, and a speaker unit that outputs an output signal from the adding circuit and the canceling signal.

11 Claims, 6 Drawing Sheets

NOISE CANCELING HEADPHONE AND NOISE CANCELING EARMUFF

BACKGROUND OF THE INVENTION

1. Field of the Invention

The present invention relates to a noise canceling headphone and a noise canceling earmuff, and in particular a noise canceling headphone and a noise canceling earmuff that allow a user to clearly hear desired external sound by compensating for external sound attenuated by a sound insulating characteristic of an ear cup while canceling external noise.

2. Related Background Art

A noise canceling headphone is known that realizes a noise-free situation by canceling unwanted sound (hereinafter referred to as "noise") in ambient sound (hereinafter referred to as "external sound") when wearing the headphone. The noise canceling headphone provides a speaker unit that outputs a musical signal input from an exterior and a noise canceling signal opposite to the noise in phase characteristic. A noise canceling earmuff is configured such that it only outputs a noise canceling signal without providing any musical-signal input mechanism, unlike the noise canceling headphone. The noise canceling headphone is similar to the noise canceling earmuff in generating and outputting the noise canceling signal for noise cancellation. This specification uses a noise canceling headphone for explanation of the present invention except where otherwise indicated. A noise canceling earmuff according to the present invention also provides features of the noise canceling headphone according to the present invention.

A conventional noise canceling headphone has the following configuration. When an electric power supply is applied, a circuit generates a noise canceling signal and a microphone included in an ear cup that configures a housing of the headphone collects external sound. The external sound collected by the microphone is converted into an electrical signal. A noise canceling signal generating circuit generates a noise canceling signal in response to the electrical signal. The generated noise canceling signal is output as a canceling sound from a speaker unit via an amplifier. The canceling sound exerts an effect of canceling noise reaching a user's ears. Accordingly the user can obtain a quiet circumstance where noise is canceled with the noise canceling headphone.

As explained above, when an electric power supply is applied, (during operation) the conventional noise canceling headphone generates and outputs a noise canceling signal that cancels the external sound collected by the microphone, thereby exerting a canceling effect on every kind of external sound. Even desired sound included in the external sound (for example, a human voice), therefore, is canceled. The user, however, may want to hear an ambient human voice in some cases, for example, when the user is on an airplane or a train while using the noise canceling headphone.

If the user tries to hear an ambient human voice while using the conventional noise canceling headphone, the operation of the noise canceling headphone needs to be stopped or the headphone removed. This manner of use is inconvenient for the user. As a solution to this problem, a noise canceling headphone is known that provides a so-called talk-through function in which "desired sound" such as an ambient human voice (hereinafter referred to as "target sound") can be heard through a speaker unit provided in the headphone, while using the noise canceling headphone (for example, see Japanese Unexamined Patent Application Publication No. 2006-014307).

A noise canceling headphone that provides the talk-through function disclosed in Japanese Unexamined Patent Application Publication No. 2006-014307 provides a second talk-through microphone for collecting the target sound in addition to a microphone for collecting the external sound. The talk-trough second microphone can be operated (by switching operation) as required. If the user wants to hear an ambient human voice, the second microphone is operated, and at other times, the second microphone is not operated. Since the second microphone, however, collects the external sound during operation, if the human voice is louder than the external sound, the louder external sound is collected by the second microphone to be output through the speaker unit, this results in the risk of causing damage to the user's eardrum.

The noise canceling signal is not generated against the external sound collected by the second microphone. When the second microphone collects steady noise especially having a large number of bass frequency components, the steady noise is output through the speaker unit, which can cause interference with the noise canceling effect. As described above, the talk-through function of the conventional noise canceling headphone has a number of problems.

SUMMARY OF THE INVENTION

The present invention is provided in view of the above problems and an object of the present invention is to provide a noise canceling headphone and a noise canceling earmuff that allow a user to clearly hear desired external sound by compensating for sound that should be normally heard (a human voice) but is attenuated by a sound insulating characteristic of the headphone in response to the amount of the attenuation, while canceling external noise, in external sounds collected by the microphone.

An aspect of the present invention is to provide a noise canceling headphone including: a microphone provided in a headphone housing, collecting external sound; a canceling signal generating circuit generating a canceling signal in response to the signal output from the microphone which cancels external sound passing through the housing without being attenuated by a sound insulating characteristic of the headphone; a compensating signal generating circuit generating a compensating signal that compensates for the external sound attenuated by the sound insulating characteristic of the headphone; an adding circuit that adds a musical signal input from an exterior to the compensating signal; and a speaker unit that outputs an output signal from the adding circuit and the canceling signal.

The present invention relates to a noise canceling earmuff including a microphone provided in a headphone housing, collecting external sound; a canceling signal generating circuit generating a canceling signal in response to the signal output from the microphone which cancels external sound passing through the housing without being attenuated by a sound insulating characteristic of the headphone; a compensating signal generating circuit generating a compensating signal that compensates for the external sound attenuated by the sound insulating characteristic of the headphone; and a speaker unit that outputs the compensating signal and the canceling signal.

According to the present invention, a passive or active sound insulating characteristic can be compensated for by adding a phase characteristic opposite to a canceling signal to the signal output from the microphone that collects external sound. Furthermore, desired external sound can be heard in a natural volume while insulating stationary noise in bass sound. The "natural volume" here is a volume of external sound in a state where the noise canceling headphone is removed.

According to the present invention, when the level of the external sound is higher than a certain level, the amount of complement to the insulating characteristic is reduced to keep an ordinary noise canceling effect, thereby enabling damage to an ear (ear drum) to be prevented at the high-volume level. Accordingly, a noise canceling headphone that exerts a noise canceling effect and is suitable for the user's environment or situation can be provided.

Furthermore, according to the present invention, target sound included in the external sound can be collected by only one microphone without a talk-through microphone in addition to the microphone for collecting the external sound.

DESCRIPTION OF THE PREFERRED EMBODIMENTS

Figure 1:
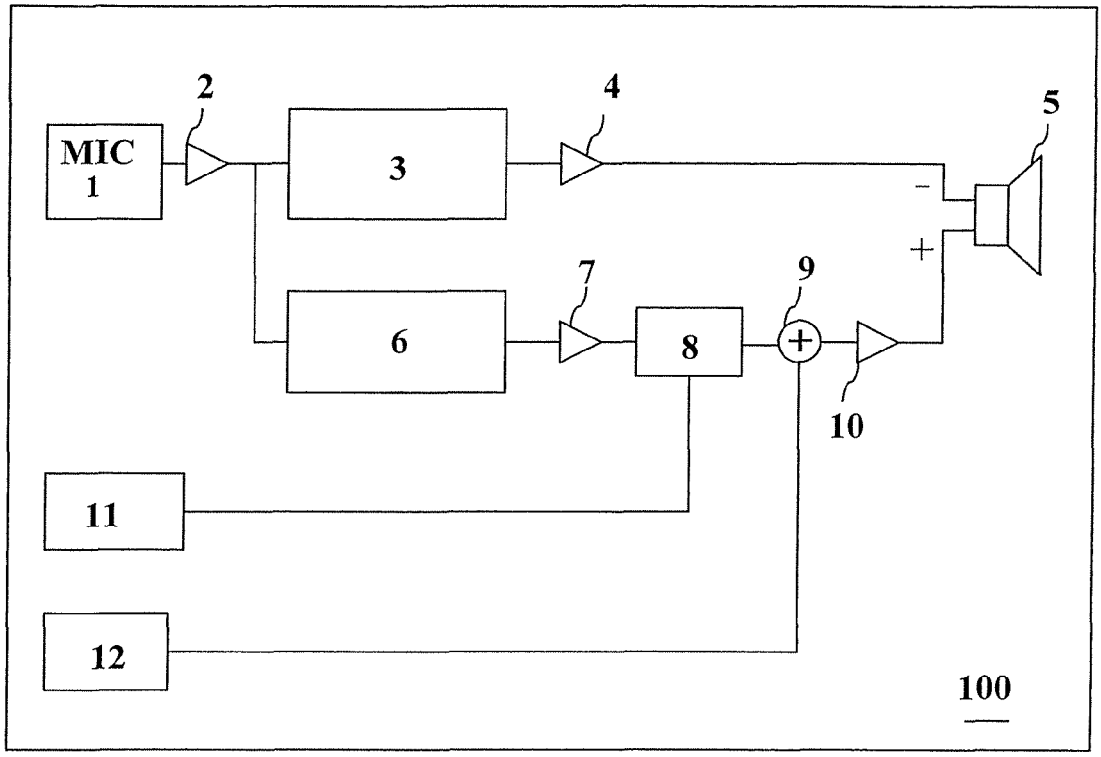
FIG. 1 is a functional block diagram of a noise canceling headphone according to an embodiment of the present invention.

Embodiments of a noise canceling headphone according to the present invention are explained below with reference to accompanying drawings. FIG. 1 is a functional block diagram of a noise canceling headphone according to an embodiment of the present invention. In FIG. 1, a noise canceling headphone 100 includes a microphone 1, a microphone amplifier 2, a canceling signal generating circuit 3, a headphone amplifier 4, a headphone unit 5, a compensating signal generating circuit 6, an amplifier 7, a switch circuit 8, an adding circuit 9, a headphone amplifier 10, a switch controller 11 and a musical-sound signal input terminal 12.

The microphone 1 is attached to components (not shown) of the noise canceling headphone 100 (for example, an ear cup and a headband). The microphone 1 (referred to as mic 1 in FIG. 1) collects external sound to to convert the sound into an electric signal and outputs the electric signal. The microphone amplifier 2 is an amplifying circuit that amplifies the signal output from the microphone 1 and outputs the amplified signal to the canceling signal generating circuit 3. The canceling signal generating circuit 3 is a circuit that generates and outputs a signal (canceling signal) having a phase characteristic opposite to sound in the external sound which reaches a user through the ear cup or an ear pad (audible sound), in response to the signal output from the microphone amplifier 2. In other words, the canceling signal generating circuit 3 is a circuit that generates and outputs a signal for canceling audible external sound entering without being attenuated by a sound insulating characteristic of the headphone.

The headphone amplifier 4 is an amplifying circuit that drives the headphone unit 5 by the canceling signal. The headphone unit 5 driven by the headphone amplifier 4 outputs a canceling sound. The headphone unit 5 includes a speaker unit outputting a synthesized signal of the canceling signal and a later-described compensating signal, or a synthesized signal of the compensating signal and a musical sound signal. As the canceling signal is output from the headphone unit 5, an effect is generated that cancels the audible external sound not attenuated by the sound insulating characteristic of the headphone.

The compensating signal generating circuit 6 is a circuit that generates a compensating signal compensating for attenuation by the sound insulating characteristic of the headphone in response to the signal output from the microphone amplifier 2. The compensating signal is a signal compensating for the amount of the attenuation of target sound (human voice, for example) that the user prefers not to be attenuated, that is, a signal that exerts an effect to increase a gain in a certain frequency band attenuated by the sound insulating characteristic so that the user can hear the target human voice at a level equal to a state where the headphone is removed. The compensating signal generating circuit 6 is a filter circuit that outputs a compensating signal (a signal having a frequency amplifying characteristic opposite to the sound insulating characteristic of the headphone) by combing a plurality of filter circuits.

The amplifier 7 is an amplifying circuit that amplifies the compensating signal output from the compensating signal generating circuit 6. The switch circuit 8 is a circuit that switches between on/off operation of outputting the compensating signal output from the amplifier 7 to the headphone unit 5. The switch circuit 8 performs the switching operation with a switch controller 11 attached, for example, to a housing such that the user can operate the switch controller 11. That is, the output of the compensating signal from speaker unit 5 can be switched by the user's operation. The compensating sound exerts an effect which makes the target sound audible. The noise canceling headphone 100 can be operated by the user's operation of the switch controller 11 so that the user can hear the target sound more clearly. In other words, on/off switching operation of a function corresponding to the so-called talk-through function of the noise canceling headphone 100 is realized by the user's operation of the switch controller 11.

The adding circuit 9 is a circuit that adds a musical signal input from an unshown musical sound reproducing device (for example, an audio player) connected via a musical-sound signal input terminal, to the compensating signal and outputs the added signal. The headphone amplifier 10 is an amplifying circuit that drives the headphone unit 5 by the signal output from the adding circuit 9 to output musical sound or synthesized sound of the musical sound and the compensating sound.

The headphone unit 5 provides two input terminals. The noise canceling signal is input to one input terminal while the musical sound signal and the compensating signal are input to the other terminal. In FIG. 1, the noise canceling headphone 100 is configured such that the compensating signal and the musical sound signal are input to a plus terminal of the headphone unit 5 whereas the noise canceling signal is input to a minus terminal. The noise canceling signal and the musical sound signal are input respectively into the two terminals provided to the headphone unit 5, thereby preventing deterioration of musical sound quality to achieve higher musical-sound quality. In the noise canceling headphone 100 according to the embodiment, the signals may be inversely input to the two terminals of the headphone unit 5. That is, the canceling signal may be input to the plus terminal while the compensating signal and the musical sound signal may be input to the minus terminal.

Next, an operation of the noise canceling headphone 100 according to the present invention is explained. The ear cup as a housing of the headphone 100 and the ear muff have a sound insulating characteristic that attenuates the external sound at a certain amount before reaching the user's ear. The microphone 1 provided in the noise canceling headphone 100 is mounted on the exterior of the headphone housing to collect the external sound. The sound collected by the microphone 1 is, thus, dissimilar to the external sound heard by the user. For the purpose of canceling the external sound that is audible to the user, the canceling signal generating circuit 3 generates the canceling signal having a phase characteristic opposite to the sound entering without being attenuated by the sound insulating characteristic of the headphone.

As the canceling signal is output from the headphone unit 5, the external sound is canceled. The external sound, however, includes sound that is preferably audible to the user and/or desired sound (target sound). A specific example of the target sound is a human voice. Cancellation of the target sound by the canceling sound causes difficulty in conversation with the noise canceling headphone 100 in use. In order to have a conversation while using the noise canceling headphone 100, the noise canceling headphone 100 needs to be removed or its operation stopped. When the noise canceling headphone 100 is, for example, removed, the human voice may be disadvantageously difficult to hear because of the ambient external sound.

The noise canceling headphone 100 is configured so that the compensating signal generated by the compensating signal generating circuit 6 compensates for the amount of the attenuation by increasing the gain in the certain frequency band corresponding to the target sound in the external sound that is attenuated by the sound insulating characteristic of the headphone. That is, only the sound in the certain frequency band corresponding to the target sound can be heard in a volume equal to a volume in a state where the noise canceling headphone 100 is removed. Accordingly, the external sound other than the external sound in the certain frequency band is canceled by the canceling sound, and the external sound in the certain frequency band can be heard in a state equal to the state where the noise canceling headphone 100 is removed. As an effect according to the present invention, after the noise is canceled, the sound in the certain frequency band corresponding to the target sound can be heard in the volume equal to the volume in a state where the noise canceling headphone 100 is removed, thereby allowing the user to hear the target sound more clearly.

As described above, with the noise canceling headphone according to the present invention, an ambient human voice can be heard in a natural volume equal to the volume in the state where the headphone is removed, while canceling unwanted sound in the external sound.

Figure 2:
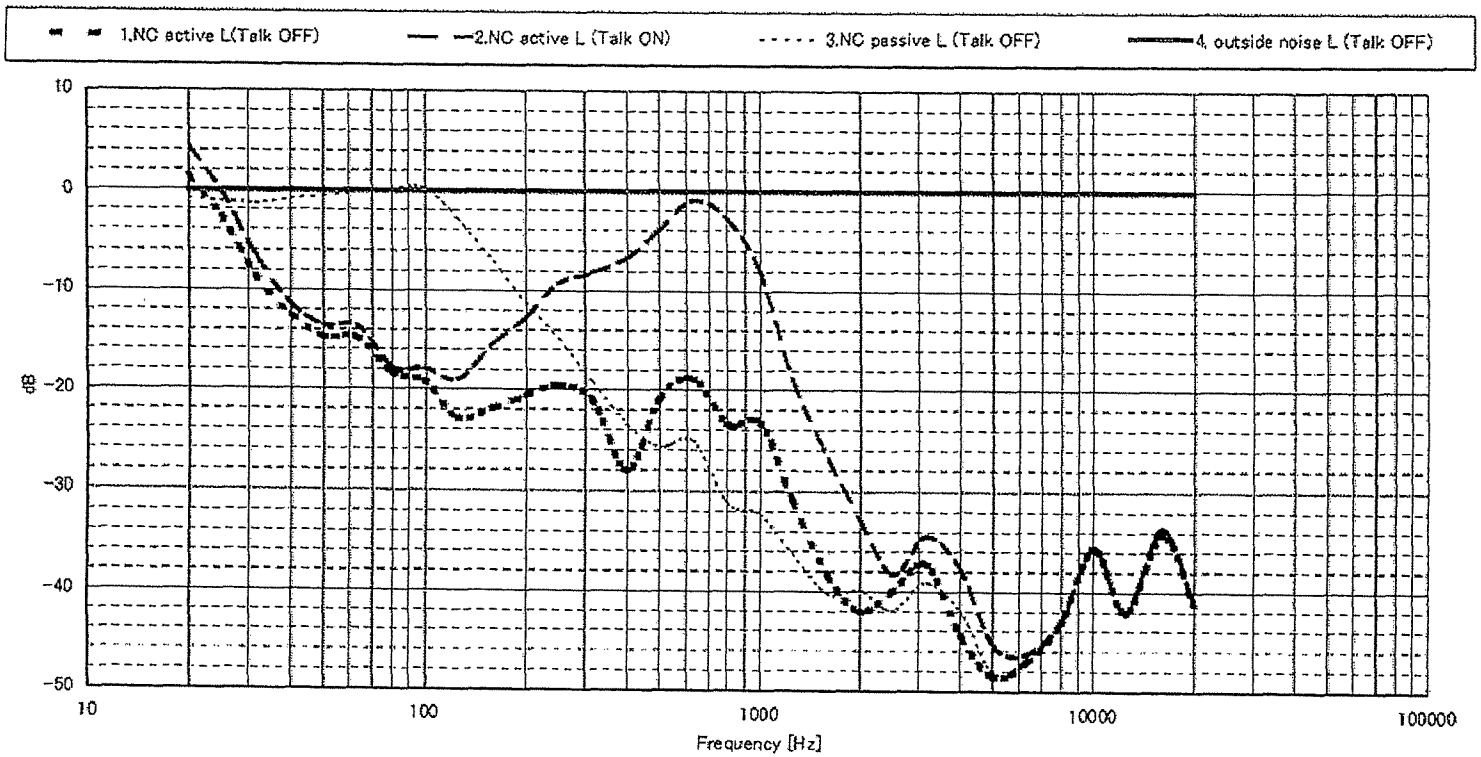
FIG. 2 is a frequency characteristic graph of the noise canceling headphone in FIG. 1.

The effect of the noise canceling headphone according to the present invention is further explained. FIG. 2 is a frequency characteristic graph of the noise canceling headphone according to the present invention. A lateral axis represents a frequency and a longitudinal axis represents a gain. FIG. 2 shows four lines (lines 1 to 4). Line 1 shows a frequency characteristic in a state where the noise canceling headphone according to the present invention operates (the canceling signal is output) and an output of the compensating signal is insulated by the switch. In other words, line 1 shows a frequency characteristic equal to that of the conventional noise canceling headphone.

Line 2 shows a frequency characteristic in a state where the noise canceling headphone according to the present invention operates and the compensating signal is output. Line 3 shows a sound insulating characteristic of the noise canceling headphone. Line 4 shows a frequency characteristic of noise collected by the microphone.

In line 1, the noise canceling headphone according to the present invention has a feature that exerts a canceling effect on a frequency higher than 100 Hz with the canceling signal and the level of the canceling effect increases as the frequency becomes higher. Since the human voice as the target sound lies in frequency band in the neighborhood of 800 Hz, it is found that the human voice is canceled by the canceling sound.

Compared to line 1, line 2 shows that the noise canceling headphone according to the present invention definitely exerts a specific effect. That is, according to the frequency characteristic shown in line 2, the gain in the neighborhood of the frequency band 800 Hz corresponding to the frequency band of the target sound has a level equal to the sound collected by the microphone 1. The sound in this frequency band, thus, is compensated for by the compensating signal to be easy to hear. In a low frequency band of equal to or lower than 200 Hz, which is a main frequency band of the steady noise, a canceling effect equal to the canceling effect of the conventional noise canceling headphone is exerted (line 1).

As explained above, in the noise canceling headphone according to the present invention, steady noise in a low frequency band that is difficult to insulate by a sound-isolating headphone can be canceled. Furthermore, since the external sound attenuates in a high frequency band equal to or higher than 2 kHz which is unnecessary for conversation, a state can be achieved where the sound in a speech band can be heard more clearly. The noise canceling headphone according to the present invention enables conversational speech to be heard in a natural volume while maintaining a canceling effect equal to a canceling effect by the conventional noise canceling headphone.

Embodiment 2

Figure 3:
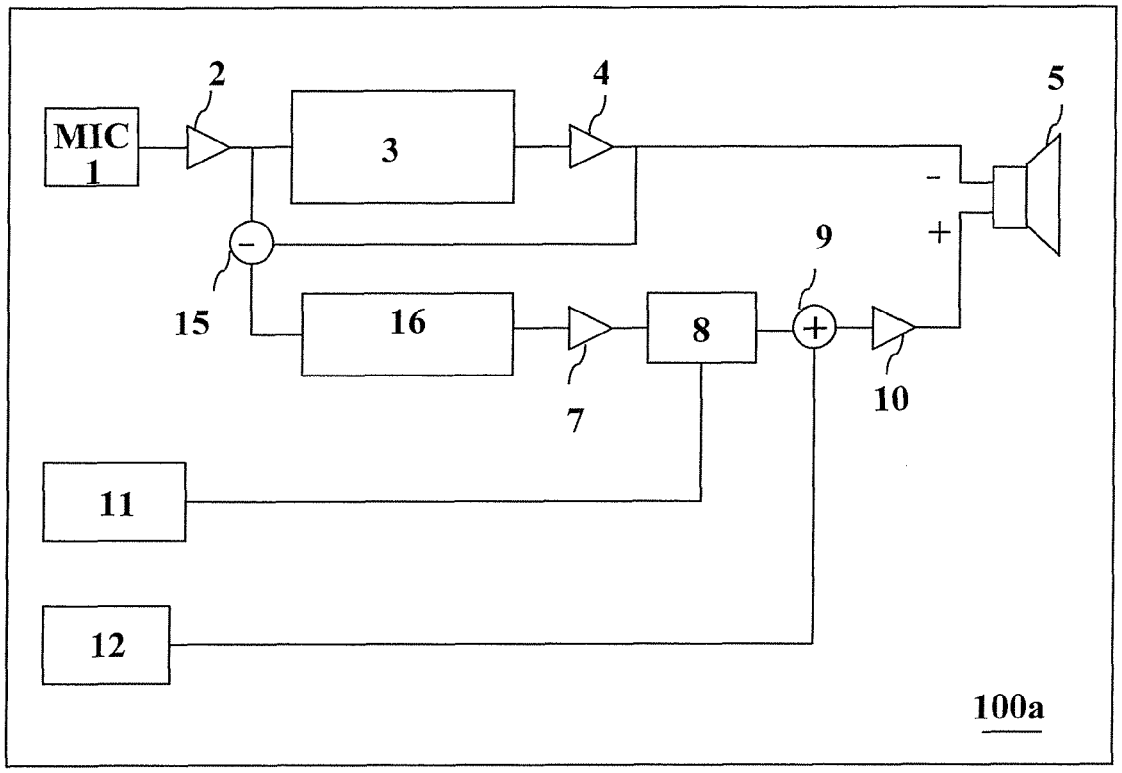
FIG. 3 is a functional block diagram of the noise canceling headphone according to another embodiment of the present invention.

Next, another embodiment of the noise canceling headphone according to the present invention is explained below with reference to FIG. 3. Structures similar to those of the noise canceling headphone 100 according to the above-explained embodiment 1 are omitted. In FIG. 3, a noise canceling headphone 100*a* has a difference operation circuit 15 and a band-pass filter circuit 16, instead of the compensating signal generating circuit 6 in the embodiment 1 (FIG. 1). A noise canceling signal output from the headphone amplifier 4 and a signal according to the external sound output from the microphone amplifier 2 are input to the difference operation circuit 15.

The difference operation circuit 15 is a circuit that outputs a difference between the two input signals. That is, the difference is output between the signal output from the microphone amplifier 2 and the canceling signal. In other words, the difference operation circuit 15 adds a phase characteristic opposite to the noise canceling signal to the signal output from the microphone amplifier 2 (signal according to the external sound). An output signal accordingly generated by the difference operation circuit 15 becomes a signal that compensates for sound attenuated by the sound insulating characteristic of the headphone.

The signal output from the difference operation circuit 15 is output to the headphone unit 5 through the band-pass filter circuit 16 which passes a signal only in a predetermined band.

This realizes an increase of the gain in the certain frequency band corresponding to the target sound attenuated by the sound insulating characteristic of the headphone. A high-pass filter or a band-pass filter may be used in place of the band-pass filter circuit 16 as long as they pass the signal in a frequency band of a voice.

In the noise canceling headphone 100*a* according to the embodiment, the compensating signal output from the band-pass filter circuit 16 compensates for the amount of attenuation in the frequency band characteristic corresponding to that of the target sound. The canceling signal, further, cancels the noise attenuated by the sound insulating characteristic, thereby allowing the user to hear the target sound (human voice) while canceling the noise, in the natural volume equal to the volume in a state where the headphone is removed.

As explained above, in the noise canceling headphone according to the present invention, bass steady noise that is difficult to be insulated by a sound-isolating headphone, can be canceled. Furthermore, since the external sound attenuates in a high frequency band equal to or higher than 2 kHz which is unnecessary for conversation, a state can be achieved where the sound in a speech band can be heard more clearly. The noise canceling headphone according to the present invention enables conversational speech to be heard in a more natural volume while maintaining a canceling effect equal to that of the conventional noise canceling headphone.

Embodiment 3

Next, another embodiment of the noise canceling headphone according to the present invention is explained below with reference to FIG. 4. Structures similar to those of the noise canceling headphone 100 and the noise canceling headphone 100*a* according to the above-explained embodiments 1 and 2 are omitted.

Figure 4:
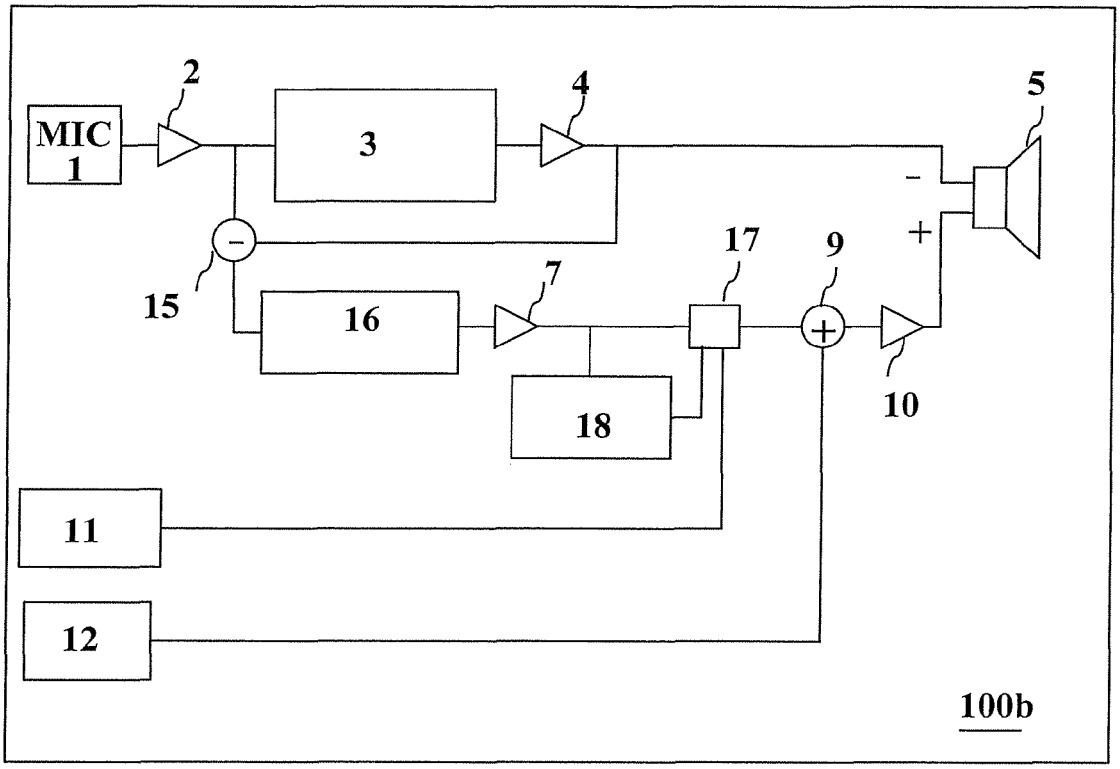
FIG. 4 is a functional block diagram of the noise canceling headphone according to yet another embodiment of the present invention.

In FIG. 4, a noise canceling headphone 100*b* has a level detecting circuit 18 that detects a level of the signal output from the amplifier 7, that is, the compensating signal and operates a switch 17.

The level detecting circuit 18 outputs a control signal to the switch 17, when the level of the compensating signal rises above a predetermined threshold level. The switch 17 is configured to be opened in response to the control signal output from the level detecting circuit 18 "automatic" mode. That is, when the control signal is output from the level detecting circuit 18, in other words, when the level of the compensating signal rises above the predetermined level, the switch 17 is opened and a compensating sound stops being output from the headphone unit 5.

Accordingly, when a loud noise is collected by the microphone 1, the headphone unit 5 outputs only the canceling signal without the compensating signal to be in a state where the external sound is attenuated by the sound insulating characteristic, thereby preventing damage to the eardrum by the loud noise.

Embodiment 4

Next, yet another embodiment of the noise canceling headphone according to the present invention is explained below with reference to FIG. 5. A noise canceling headphone 100*c* illustrated in FIG. 5 has structures similar to those explained in the embodiments 1, 2 and 3. Structures different from those of the embodiments 1, 2 and 3 are mainly explained hereinbelow.

Figure 5:
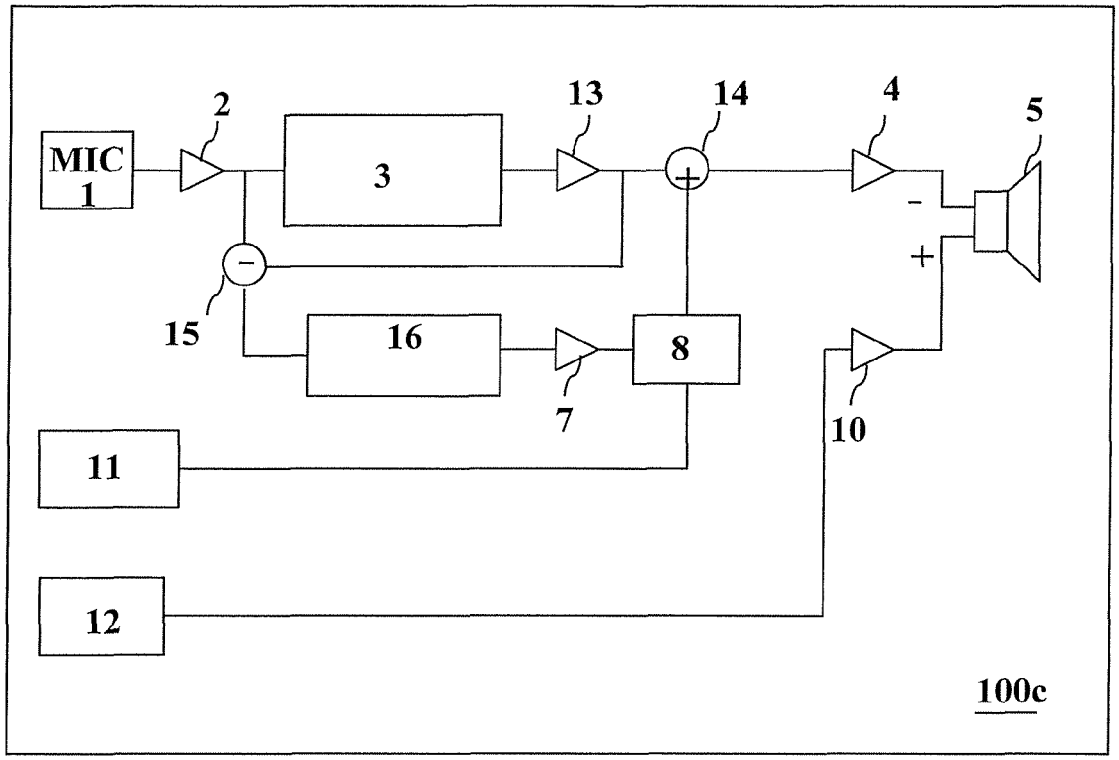
FIG. 5 is a functional block diagram of the noise canceling headphone according to yet another embodiment of the present invention.

In FIG. 5, the noise canceling headphone 100*c* has an amplifier 13 that amplifies the canceling signal output from the canceling signal generating circuit 3 with a predetermined amplification degree to output the amplified signal and a summing amplification circuit 14 that sums and amplifies the signal output from the amplifier 13 and the compensating signal to output a resulting signal.

The noise canceling headphone 100*c* according to the embodiment is configured such that the signal that is the sum of the canceling signal and the compensating signal is input through the headphone amplifier 4 to one terminal of the headphone 5 (minus terminal in FIG. 5) while the musical sound signal is input through the headphone amplifier 10 to the other terminal (plus terminal in FIG. 5). In this case, the minus terminal of the headphone unit 5 only needs to be connected to a ground circuit (not shown).

Embodiment 5

Figure 6:
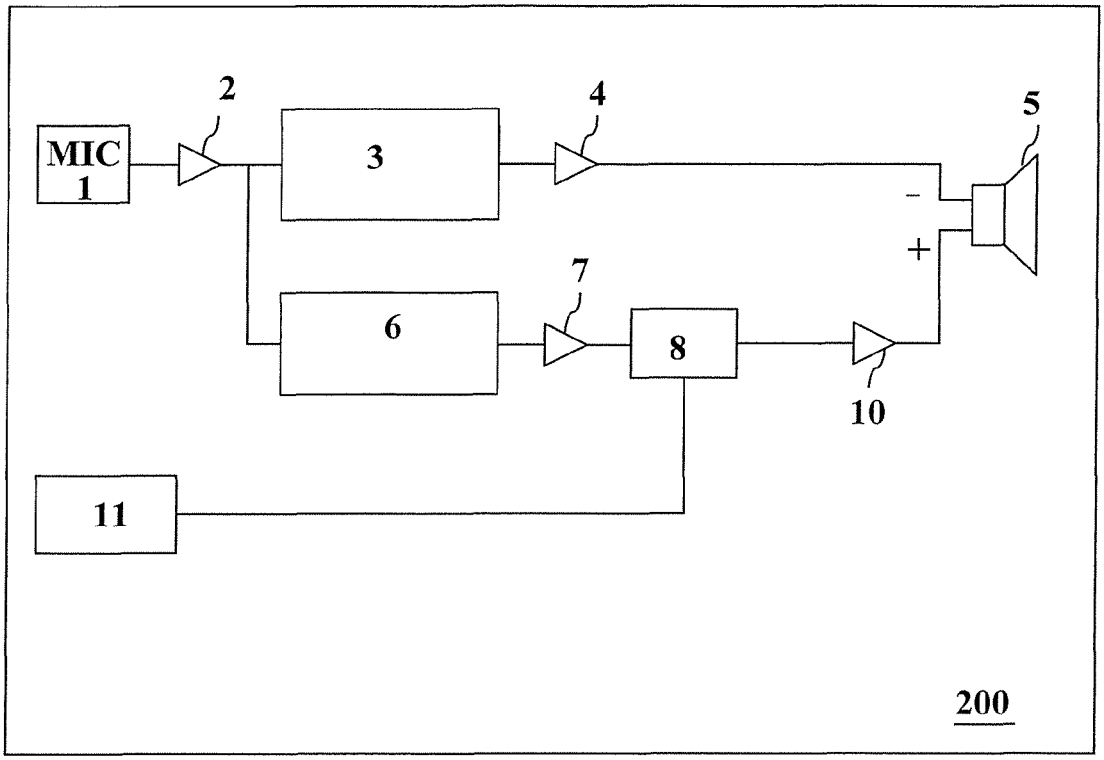
FIG. 6 is a functional block diagram of a noise canceling earmuff according to an embodiment of the present invention.

Next, an embodiment of the noise canceling earmuff according to the present invention is explained below with reference to FIG. 6. In FIG. 6, the noise canceling earmuff 200 includes the microphone 1 attached to an unshown earmuff housing (ear cup or headband) to collect noise and external sound, the microphone amplifier 2 that amplifies a signal output from the microphone 1, the canceling signal generating circuit 3 that generates a canceling signal having a phase characteristic opposite to the noise attenuated by an insulating characteristic of the headphone in response to the signal output from the microphone amplifier 2; the headphone amplifier 4 that amplifies the canceling signal with a predetermined amplification degree to output an amplified signal; the compensating signal generating circuit 6 that generates a compensating signal compensating for sound attenuated by the insulating characteristic of the headphone in response to the signal output from the microphone amplifier 2; the amplifier 7 that amplifies the compensating signal output from the compensating signal generating circuit 6; the switch 8 that switches the output of the compensating signal; the headphone amplifier 10 operatively attached to the housing (such as the ear cup); the switch controller 11 that opens and closes the switch 8 by the user's operation; the headphone amplifier 10 that amplifies the compensating signal; and the headphone unit 5 having two input terminals, which inputs the signal output from the headphone amplifier 4 to one terminal and inputs the signal output from the headphone amplifier 10 to the other terminal and outputs canceling sound and compensating sound by electro-acoustic conversion.

The noise canceling earmuff 200 according to the embodiment has the same components as the noise canceling headphone 100 described in the embodiment 1 except for the musical sound input terminal 12 and the adding circuit 9.

According to the noise canceling earmuff of the embodiment, the microphone 1 can collect sound in a predetermined frequency band such as a human voice, attenuated by a sound insulating characteristic of the noise canceling earmuff, and the compensating signal generating circuit 6 generates the compensating signal that compensates for the amount of the attenuation of the sound. Target sound, thus, can be heard in a natural volume equal to a volume in a state where the noise canceling earmuff is removed.

As explained above, the noise canceling headphone and the noise canceling earmuff according to the present invention enable external sound to be heard in a natural volume equal to a volume in a state where the noise canceling earmuff is removed, by compensating for the sound insulating characteristic of the earmuff itself against passive noise.

In the noise canceling headphone and the noise canceling earmuff according to the present invention, although when wearing the noise canceling headphone, the sound insulating characteristic attenuates sound including a human voice that the user normally wants to hear, the human voice can be heard in a volume equal to a volume in a state where the noise canceling headphone is removed, by compensating for the amount of attenuation with a compensating signal. At the same time, the desired sound can be heard more clearly because only the noise in the sound is canceled by the canceling signal.

In the noise canceling headphone and the noise canceling earmuff according to the present invention, the noise level specified by the user and the high sound level causing a hearing defect are automatically detected. An output of the compensating signal can be automatically stopped when external sound having such a level enters, and only the canceling signal can be output. This enables the user to hear the external sound in other than the bass band when the external sound is at a low level, with a volume and sound quality equal to those in a state where the canceling headphone is removed.

In the noise canceling headphone and the noise canceling earmuff according to the present invention, therefore, conversation with another person is possible while the user is wearing the noise canceling headphone or the noise canceling earmuff. Furthermore, the other person's voice can be to heard more clearly because of canceling the bass noise. By adjusting the frequency band heard as external sound, sounds necessary for safe traveling (audible alerts) can be heard in a natural volume, thereby ensuring that the user can safely wear the noise canceling headphone or the noise canceling earmuff.

What is claimed is:

1. A noise canceling headphone comprising:

a microphone provided in a headphone housing, the microphone configured for collecting an external sound and outputting a microphone signal, the external sound including a first component passing through the headphone housing without being substantially attenuated by a sound insulating characteristic of the noise canceling headphone and a second component having a substantial amount of attenuation by the sound insulating characteristic of the noise canceling headphone;

a canceling signal generating circuit generating a canceling signal in response to the microphone signal, the canceling signal cancels the first component of the external sound;

a compensating signal generating circuit generating a compensating signal, the compensating signal compensates for the second component of the external sound;

an adding circuit configured for adding a musical signal input to the compensating signal and generating an adding signal; and a speaker unit outputting the adding signal and the canceling signal, wherein the compensating signal generating circuit is a filter circuit that generates the compensating signal for compensating the amount of substantial attenuation in a frequency band characteristic corresponding to the second component of the external sound in response to the microphone signal.

2. The noise canceling headphone according to claim 1, wherein the compensating signal generating circuit comprises a difference operation circuit that outputs a difference between the microphone signal and the canceling signal; and a band-pass filter circuit that extracts a signal only in a predetermined band from a signal output from the difference operation circuit.

3. The noise canceling headphone according to claim 2, wherein the band-pass filter circuit extracts the signal only in a voice band.

4. The noise canceling headphone according to claim 1, further comprising:

a switch circuit that switches the compensating signal from the speaker unit.

5. The noise canceling headphone according to claim 4, further comprising:

a level detecting circuit that detects a signal level of the compensating signal, wherein the switch circuit is operated to stop an output of the compensating signal when the signal level of the detected compensating signal is higher than a predetermined signal level.

6. The noise canceling headphone according to claim 4, further comprising:

a band level detecting circuit that detects a signal level of the compensating signal in a predetermined band, wherein the switch circuit is operated to stop the output of the compensating signal when the signal level of the detected compensating signal in the predetermined band is higher than a predetermined signal level.

7. The noise canceling headphone according to claim 5, wherein the predetermined signal level compared with the compensating signal is automatically varied.

8. The noise canceling headphone according to claim 6, wherein the predetermined signal level compared with the compensating signal is automatically varied.

9. The noise canceling headphone according to claim 5, further comprising an operating section that allows a user to vary the predetermined signal level compared with the compensating signal.

10. The noise canceling headphone according to claim 6, further comprising an operating section that allows a user to vary the predetermined signal level compared with the compensating signal.

11. A noise canceling earmuff comprising:

a microphone provided in a earmuff housing, the microphone configured for collecting an external sound and outputting a microphone signal, the external sound including a first component passing through the earmuff housing without being substantially attenuated by a sound insulating characteristic of the noise canceling earmuff and a second component having a substantial amount of attenuation by the sound insulating characteristic of the noise canceling earmuff;

a canceling signal generating circuit generating a canceling signal in response to the microphone signal, the canceling signal cancels the first component of the external sound;

a compensating signal generating circuit generating a compensating signal, the compensating signal compensates for the second component of the external sound; and a speaker unit outputting the compensating signal and the canceling signal, wherein the compensating signal generating circuit is a filter circuit that generates the compensating signal for compensating the amount of substantial attenuation in a frequency band characteristic corresponding to the second component of the external sound in response to the microphone signal.

* * * * *